United States Patent [19]

Hanson

[11] Patent Number: 4,723,599

[45] Date of Patent: Feb. 9, 1988

[54] LANCED FIN HEAT EXCHANGER

[75] Inventor: Oved Hanson, Carrollton, Tex.

[73] Assignee: Lennox Industries, Inc., Dallas, Tex.

[21] Appl. No.: 22,864

[22] Filed: Mar. 6, 1987

[51] Int. Cl.[4] ..... F28D 1/04

[52] U.S. Cl. ..... 165/151; 165/181

[58] Field of Search ..... 165/151, 181

[56] References Cited

U.S. PATENT DOCUMENTS

| | | | |
|---|---|---|---|
| 1,416,570 | 5/1922 | Modine | 165/151 |
| 1,557,467 | 10/1925 | Modine | 165/151 |
| 2,246,258 | 6/1941 | Lehman | 165/151 X |
| 4,434,844 | 3/1984 | Saketoni et al. | 165/151 |

FOREIGN PATENT DOCUMENTS

| | | | |
|---|---|---|---|
| 321270 | 4/1957 | Switzerland | 165/181 |

*Primary Examiner*—Albert W. Davis, Jr.
*Assistant Examiner*—Peggy Neils
*Attorney, Agent, or Firm*—Allegretti, Newitt, Witcoff & McAndrews, Ltd.

[57] ABSTRACT

In this heat exchanger, an improvement comprises the following. The fin plates each have louvered portions interposing the aligned openings in the fin plates. The louvered portions in each fin plate define a nominal plane and include a plurality of louvers and a base. The base has base portions including rise portions and flank portions, three each. The rise portions and flank portions alternate with each other in a transverse direction across the width of the fin plate. The rise portions and flank portions form three peaks, which are a central peak and two outer peaks. The peaks are raised in a first direction perpendicular to the nominal plane. The rise portions and flank portions further form two valleys in the opposite, second direction perpendicular to the nominal plane. The valleys are spaced from each other and are each between the central peak and an outer peak. The rise portions are substantially parallel to each other and intersect the nominal plane at a first acute angle. The flank portions are substantially parallel to each other and intersect the nominal plane at a second acute angle substantially equal in degree and opposite in direction to the first acute angle. Each rise portion and flank portion has a louver thereon, each louver being a "resident louver" of the base portion which has the louver thereon, and each resident louver having a base portion being a "residence base portion" therefor. Each louver has a single louver wall.

3 Claims, 4 Drawing Figures

LANCED FIN HEAT EXCHANGER

TECHNICAL FIELD OF THE INVENTION

This invention pertains to the field of finned tube heat exchangers, and more particularly to an improved fin configuration for increasing heat transfer efficiency.

BACKGROUND OF THE INVENTION

Finned tube heat exchangers are widely used in a variety of applications in the fields of refrigeration, air conditioning and the like. Such heat exchangers consist generally of a plurality of spaced parallel tubes through which a heat transfer fluid such as water, oil, air or a refrigerant is forced to flow while a second heat transfer fluid such as air is directed across the tubes. To improve heat transfer a plurality of fins comprising thin sheet metal plates are placed on the tubes. Each fin plate has a plurality of apertures through which the tubes pass generally at right angles to the fin, and a large number of the fins are arranged in parallel, closely spaced relationship along the tubes to form multiple paths for the air or other heat exchange fluid to flow across the fins and around the tubes. The tubes and plates are provided with a suitable mechanical and thermal bond, for example by expansion of the tubes after assembly of the fin plates, to provide good thermal conduction. FIG. 1 of U.S. Pat. No. 4,365,667 illustrates an example of such heat exchangers, and is incorporated by reference.

A great number of different fin designs for heat exchangers have been proposed in the prior art in the continual search for efficiency, compactness and manufacturing and operating economy. Since the fins are so important in the overall heat transfer of the heat exchanger, even a small improvement in the fin can have an important beneficial effect on overall heat exchanger performance. Numerous fin designs have been proposed in the prior art.

Despite the progress which has been made in the field, there is still a need for a finned tube heat exchanger with excellent heat transfer efficiency and superior control of air pressure drop across the unit. At the same time stiffness in the heat exchanger fins is important to simplify and speed up assembly and manufacturing procedures.

SUMMARY OF THE INVENTION

This invention provides a finned tube heat exchanger meeting the objectives of excellent efficiency, superiority in its low pressure drop in fluid flow across the fins, and sufficiency rigidity to facilitate assembly, through the provision of a fin of novel configuration.

These and other features of the invention will be apparent from the following detailed description.

DETAILED DESCRIPTION OF THE PREFERRED EMBODIMENT

Figure 1:
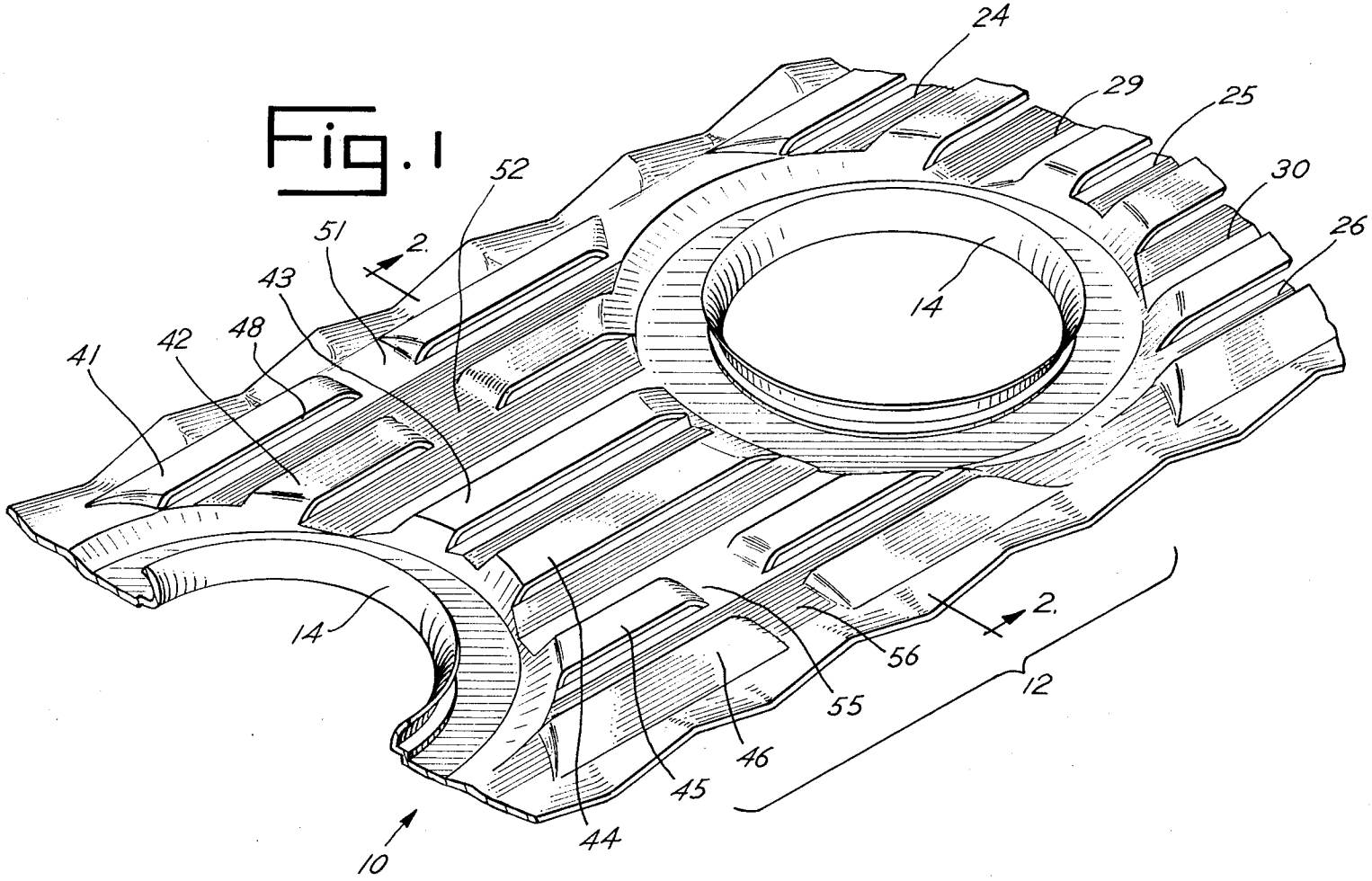
FIG. 1 is a perspective view of the preferred lanced fin heat exchanger of the invention.
Figure 2:
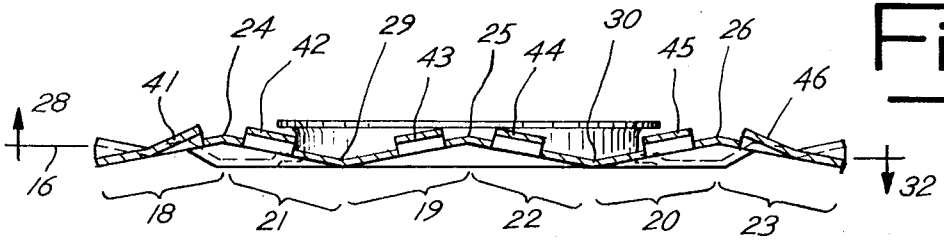
FIG. 2 is a transverse cross-section view of the preferred lanced fin heat exchanger, taken along line 2—2 in FIG. 1.
Figure 3:
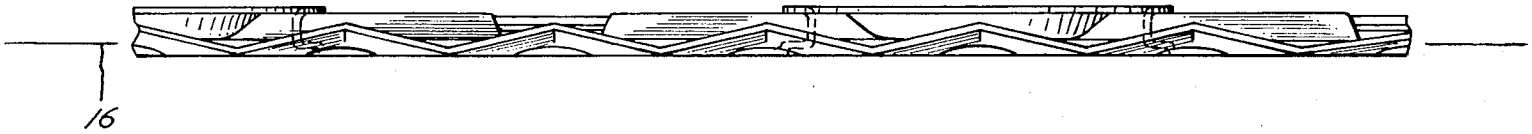
FIG. 3 is a plan view of the preferred lanced fin heat exchanger.

Referring to FIG. 1, a fin plate 10 of the preferred lanced fin heat exchanger has louvered portions 12 interposing aligned openings 14 in the fin plates. Referring to FIGS. 2 and 3, the louvered portions define a nominal plane 16. Each louvered portion 16 includes a plurality of louvers and a base, to be described.

Referring to FIG. 2, the base consists of base portions including rise portions 18, 19, 20 and flank portions 21, 22, 23. As shown, the rise portions and flank portions alternate in a transverse direction. The transverse direction is the direction across the width of the fin plate. The rise portions and flank portions alternate, by definition, in that the order of the portions from one side of the fin plate to the other side of the fin plate (left to right in FIG. 2) are: rise portion, flank portion, rise portion, flank portion, rise portion, flank portion.

The rise portions 18–20 and flank portions 21–23 form three peaks 24, 25, 26. The peaks 24–26 include a central peak 25, and two outer peaks 24, 26. The central peak 25 is central to the fin plate across the width of the fin plate. The outer peaks are transversely outward of, i.e., closer an outer edge than, the central peak 25. The peaks 24–26 are raised in a first direction, which is direction 28 in FIG. 2. The peaks 24–26 are raised a uniform distance, i.e., one identical distance, from the nominal plane 16.

The rise portions and flank portions further form two valleys 29, 30. The valleys extend away from the nominal plane 16 in the direction opposite to the first direction 28. The valleys extend in the direction 32. The valleys 29, 30 extend a uniform distance from the nominal plane 16, and the same distance as the peaks 24, 25, 26 from the nominal plane. The valleys are spaced from each other, and each valley is between the central peak 25 and an outer peak.

The rise portions 18, 19, 20 are substantially parallel to each other. The rise portions intersect the nominal plane 16 at a first acute angle. The flank portions 21, 22, 23 are also substantially parallel to each other and intersect the nominal plane at a second acute angle. The second acute angle is substantially equal in degree and opposite in direction to the first acute angle.

Each rise portion and flank portion has a louver thereon. Each louver has a "residence base portion" and each louver is a "resident" of the base portion it is on. By definition, the "residence base portion" of the louver is the rise portion or flank portion on which the louver is located. Also by definition, the louver "resides" and is a "resident" of the base portion on which it is located. Referring to FIGS. 1 and 2, the louvers are 41, 42, 43, 44, 45 and 46. These louvers are resident louvers, and the rise and flank portions are residence base portions as follows:

| Louver | Residence Base Portion |
|---|---|
| 41 | rise portion 18 |
| 42 | flank portion 21 |
| 43 | rise portion 19 |
| 44 | flank portion 22 |
| 45 | rise portion 20 |
| 46 | flank portion 23 |

Thus, louver 41 is the resident louver of rise portion 18; and rise portion 18 is the residence base portion of louver 41. Louver 42 is the resident louver of flank portion 21; louver 43 is the resident louver of rise portion 19; louver 44 is the resident of flank portion 22; louver 45 is the resident louver of rise portion 20; and louver 46 is the resident of flank portion 23.

Each louver 41–46 has a single louver wall. The louver wall 48, as for example with louver 41, is planar and free of peaks or creases. The louver wall of each louver 42–45 between the outer peaks 24, 26 is raised in the first direction from its residence base portion. The louver wall of each louver 42–45 is also substantially parallel to its residence base portion. Thus, by example, the louver wall of louver 42 is substantially parallel to the flank portion 21.

The louvers 41, 46 on the rise portion 18 and flank portion 23 outward of the outer peaks 24, 26 are sloped non-parallel to their residence base portions. The louvers 41, 46 are sloped inward toward the center, across the width, of the fin plate 10, and upward, in the first direction 28, at acute angles to their residence base portions. The inner edges of the louvers 41, 46 rise above their residence base portions the same distance as the louver walls of the louvers 42–45 are raised above the base portions 21, 19, 22, 20.

By definition, a louver is a "split louver" if, along its length, it is discontinuous, intermediate of the openings 14. The louver is a "full louver" if it is not a split louver. Referring to FIG. 1, louvers 41, 42, 45, 46 are the louvers outward of the valleys 29, 30. Louvers 43, 44 are inward of the valleys 29, 30. As shown in FIG. 1, louvers 41, 42, 45, 46 are split louvers, discontinuous at 51, 52, 55, 56, respectively. Louvers 43, 44 are full louvers.

Each louver 41–46 is uniform in width throughout its length, and the louvers 41–46 all have an identical width.

Referring to FIG. 2, the louver 41 is separated across the peak 24 from the louver 42 by a distance equal to the width of a louver. Referring to FIG. 2, the louver 43 is separated across the peak 25 from the louver 44 by a distance equal to the width of a louver. Referring to FIG. 2, the louver 45 is separated across the peak 26 from the louver 46 by a distance equal to the width of a louver. The lower 42 is separated across the valley 29 from the louver 43 by a distance equal to twice the width of a louver. The louver 44 is separated across the valley 30 from the louver 45 by a distance equal to twice the width of a louver. Thus, the louvers on the rise portions and flank portions adjacent a peak are separated from each other across the peak by the width of a louver. The louvers on rise and flank portions adjacent the valleys are separated across the valleys by a distance twice the width of a louver.

The minute structural details of the preferred fin plate 10 are now substantially completely described. As in the past, the fin plate 10 is stamped from aluminum or other suitable material.

The fin plate 10 has superior low pressure drop across its width, as well as superior heat transfer efficiency, and sufficient rigidity to facilitate assembly. The excellent functionality of the fin plate 10 is believed to be attributable to its minute structural details. The following tables are illustrative. Table 1 is a tabulation of data resulting from laboratory tests comparing the preferred exchanger of the invention to the lanced fin heat exchanger of FIG. 4, where both have dimensions of 2 rows and 12 fins per inch.

TABLE 1

Comparison Of Test Data - Exchanger Dimensions: 2 rows, 12 fins per inch

| Face Velocity - Feet Per Minute | Pressure Drop dry, inches of water column: Exchanger Of FIG. 4 | Pressure Drop dry, inches of water column: Preferred Exchanger | Heat Transfer Ra, $ft^2hr$ °F./BTU: Exchanger Of FIG. 4 | Heat Transfer Ra, $ft^2hr$ °F./BTU: Preferred Exchanger |
|---|---|---|---|---|
| 150 | — | .02 | — | .106 |
| 200 | .07 | .04 | .079 | .090 |
| 304 | .13 | .08 | .063 | .071 |
| 461 | .26 | .17 | .051 | .057 |
| 700 | .50 | .35 | .041 | .045 |

Figure 4:
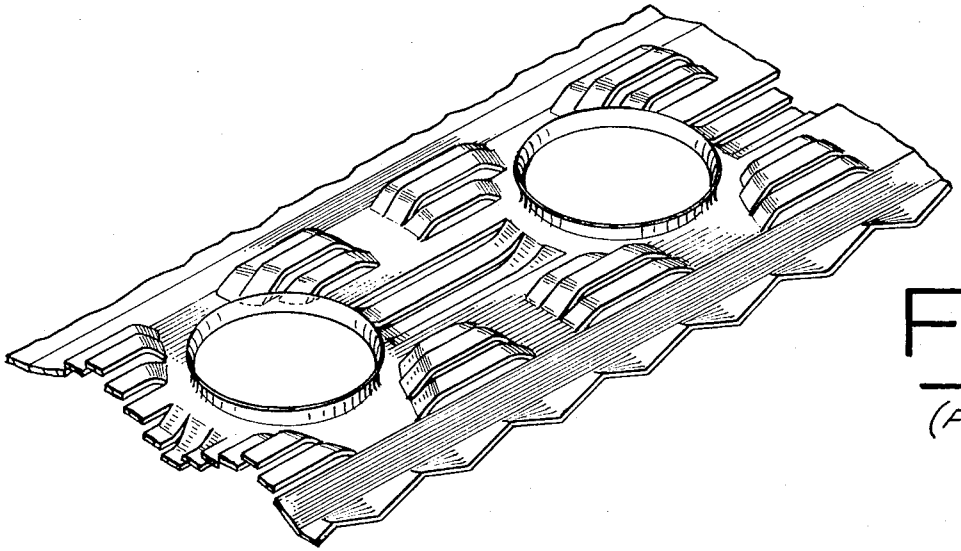
Fig. 4 (PRIOR ART)
FIG. 4 is a perspective view of a prior art lanced fin heat exchanger.

Table 2 is a tabulation of data resulting from laboratory tests comparing the preferred exchanger of the invention to the lanced fin heat exchanger of FIG. 4, where both have dimensions of 2 rows and 18 fins per inch.

TABLE 2

Comparison Of Test Data - Exchanger Dimensions: 2 rows, 18 fins per inch

| Face Velocity - Feet Per Minute | Pressure Drop dry, inches of water column: Exchanger Of FIG. 4 | Pressure Drop dry, inches of water column: Preferred Exchanger | Heat Transfer Ra, $ft^2hr$ °F./BTU: Exchanger Of FIG. 4 | Heat Transfer Ra, $ft^2hr$ °F./BTU: Preferred Exchanger |
|---|---|---|---|---|
| 150 | — | .05 | — | .102 |
| 200 | .11 | .08 | .076 | .086 |
| 304 | .19 | .15 | .061 | .067 |
| 461 | .35 | .27 | .049 | .055 |
| 700 | .68 | .52 | .041 | .043 |

Table 3 is a tabulation of data resulting from laboratory tests comparing the preferred exchanger of the invention to the lanced heat fin heat exchanger of FIG. 4, where both have the dimensions of 3 rows and 12 fins per inch.

TABLE 3

Comparison Of Test Data - Exchanger Dimensions: 3 rows, 12 fins per inch

| Face Velocity - Feet Per Minute | Pressure Drop dry, inches of water column: Exchanger Of FIG. 4 | Pressure Drop dry, inches of water column: Preferred Exchanger | Heat Transfer Ra, $ft^2hr$ °F./BTU: Exchanger Of FIG. 4 | Heat Transfer Ra, $ft^2hr$ °F./BTU: Preferred Exchanger |
|---|---|---|---|---|
| 150 | — | .04 | — | .125 |
| 200 | .09 | .06 | .092 | .103 |
| 304 | .17 | .12 | .069 | .079 |
| 461 | .32 | .23 | .057 | .061 |
| 700 | .62 | .49 | .045 | .048 |

The preferred embodiment and the invention are now described in such full, clear, concise and exact terms as to enable a person of skill in the art to make and use the same. To particularly point out and distinctly claim the subject matter regarded as invention, the following claims conclude this specification.

What is claimed is:

1. A cross finned tube heat exchanger comprising:

a multiplicity of fin plates of a suitable area arranged in substantially parallel, closely spaced relation; and a plurality of heat transfer tubes passing through aligned openings in said fin plates and kept in intimate contact with said fin plates to allow a heat transfer medium flowing through said heat transfer tubes to exchange heat with another heat transfer medium flowing across the surfaces of said fin plates;

wherein the improvement comprises:

the fin plates each having louvered portions interposing the aligned openings in the fin plates, the louvered portions in each fin plate defining a nominal plane and including a plurality of louvers and a base, the base having base portions including rise portions and flank portions, three each, which alternate in a transverse direction across the width of the fin plate, with the rise portions and flank portions forming three peaks being a central peak and two outer peaks, the peaks being raised in a first direction perpendicular to the nominal plane, the rise portions and flank portions further forming two valleys in the opposite, second direction perpendicular to the nominal plane, the valleys spaced from each other and each being between the central peak and an outer peak, the rise portions being substantially parallel to each other and intersecting the nominal plane at a first acute angle and the flank portions being substantially parallel to each other and intersecting the nominal plane at a second acute angle substantially equal in degree and opposite in direction to the first acute angle, each rise portion and flank portion having a louver thereon, each louver being a resident louver of the base portion which has the louver thereon, and each resident louver having a base portion being a residence base portion therefor, each louver having a single louver wall, the louver wall of each louver between the outer peaks being raised in the first direction from the residence base portion of which the louver is resident, the louver wall of each louver inward of the outer peaks being substantially parallel to the residence base portion of which the louver is resident, the louvers on the rise portions and flank portions outward of the outer peaks being sloped inward and upward in the first direction the same distance as the distance which the louver walls of the louvers between the outer peaks are raised, the louvers outward of the valleys being split louvers and the louvers between the valleys being full louvers, each of the louvers having a substantially uniform width and all the louvers having a width substantially equal to the width of each other.

2. A cross finned tube heat exchanger as in claim 1 in which the louvers on the rise portion and flank portion adjacent each peak are separated across the peak by a distance substantially equal to the width of a louver.

3. A cross finned tube heat exchanger as in claim 2 in which the louvers on the rise portion and flank portion adjacent each valley are separated across the valley by a distance substantially equal to twice the width of a louver.

* * * * *